US010022841B2

(12) United States Patent
Hsu et al.

(10) Patent No.: US 10,022,841 B2
(45) Date of Patent: Jul. 17, 2018

(54) NONWOVEN ABRASIVE ARTICLE WITH EXTENDED LIFE

(75) Inventors: Shyiguei Hsu, McAllen, TX (US); Alejandro Gomez, Tamaulipas (MX); Godofredo Vela, McAllen, TX (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 212 days.

(21) Appl. No.: 13/536,696

(22) Filed: Jun. 28, 2012

(65) Prior Publication Data

US 2013/0012112 A1 Jan. 10, 2013

Related U.S. Application Data

(60) Provisional application No. 61/503,539, filed on Jun. 30, 2011.

(51) Int. Cl.

| | |
|---|---|
| ***B24D 11/02*** | (2006.01) |
| ***B24D 3/28*** | (2006.01) |
| ***D04H 1/60*** | (2006.01) |
| ***B24D 11/00*** | (2006.01) |
| ***D04H 1/413*** | (2012.01) |
| ***D04H 1/4382*** | (2012.01) |

(52) U.S. Cl.

CPC ..... *B24D 3/28* (2013.01); *B24D 11/005* (2013.01); *D04H 1/413* (2013.01); *D04H 1/4382* (2013.01); *D04H 1/60* (2013.01)

(58) Field of Classification Search

CPC ..... B24D 11/00; B24D 11/001; B24D 11/005; B24D 3/28; B24D 7/04; B24D 3/344; D04H 1/42; D04H 1/60; D04H 1/65; A47L 11/4038; A47L 11/4036

USPC ..... 451/532, 536; 51/295; 442/342, 344; 428/323; 15/229.11, 230, 230.12

See application file for complete search history.

(56) References Cited

U.S. PATENT DOCUMENTS

| | | | | |
|---|---|---|---|---|
| 2,284,715 A | * | 6/1942 | Melton et al. | 451/532 |
| 2,404,207 A | | 7/1946 | Ball | |
| 2,958,593 A | * | 11/1960 | Hoover et al. | 51/295 |
| 3,324,609 A | | 6/1967 | Stein et al. | |

(Continued)

FOREIGN PATENT DOCUMENTS

WO WO2010056835 * 11/2009 ..... A47L 13/16

OTHER PUBLICATIONS

Why Use Silanes as Coupling Agent? (-Silanes Coupling Agents Center),Dec. 31, 2005, http://www.specialchem4polymers.com/tc/silanes-coupling/index.aspx?typ=a.*

(Continued)

*Primary Examiner* — Joseph J Hail
*Assistant Examiner* — Arman Milanian
(74) *Attorney, Agent, or Firm* — Abel Law Group, LLP; Joseph P Sullivan

(57) ABSTRACT

Abrasive articles including a non-woven web of staple fibers that form a single layer that is free of any additional layers of non-woven webs of staple fibers. The abrasive articles contain abrasive particles bound to the non-woven web. The abrasive articles can be compressed abrasive articles that include a non-woven web of staple fibers, including blends of staple fibers having a first portion of fibers having a first linear density and a second portion of fibers having a second linear density.

8 Claims, 5 Drawing Sheets

(56) References Cited

U.S. PATENT DOCUMENTS 3,862,522 A * 1/1975 Mednick ..... 451/532
4,227,350 A 10/1980 Fitzer
4,355,489 A * 10/1982 Heyer ..... B24D 3/002 451/532
4,486,200 A 12/1984 Heyer et al.
4,889,764 A * 12/1989 Chenoweth ..... D04H 1/60 428/373
5,152,809 A 10/1992 Mattesky
5,250,085 A * 10/1993 Mevissen ..... C09K 3/1409 51/293
5,282,900 A * 2/1994 McDonell ..... A47L 13/17 134/2
5,298,315 A * 3/1994 Fukui et al. ..... 442/387
5,591,239 A 1/1997 Larson et al.
5,626,512 A * 5/1997 Palaikis et al. ..... 451/536
5,662,728 A * 9/1997 Groeger ..... B01D 39/163 428/323
5,681,361 A * 10/1997 Sanders, Jr. ..... B24D 11/001 51/295
5,681,469 A * 10/1997 Barboza ..... B01D 29/111 210/500.1
5,685,935 A * 11/1997 Heyer ..... A47L 17/08 156/178
5,849,052 A * 12/1998 Barber, Jr. ..... 51/298
5,858,140 A * 1/1999 Berger et al. ..... 156/62.2
5,908,477 A * 6/1999 Harmer et al. ..... 51/305
5,919,549 A * 7/1999 Van ..... B24D 3/004 428/141
5,928,070 A 7/1999 Lux
5,931,729 A * 8/1999 Penttila et al. ..... 451/532
6,024,813 A * 2/2000 Groeger ..... A62D 5/00 156/272.2
6,302,930 B1 10/2001 Lux
6,312,484 B1 * 11/2001 Chou ..... B24D 3/002 51/295
6,352,567 B1 3/2002 Windisch et al.
6,679,758 B2 1/2004 Bright et al.
6,783,562 B2 8/2004 Smith
6,800,019 B2 10/2004 Tanaka et al.
6,858,292 B2 2/2005 Kendall
6,979,713 B2 12/2005 Barber, Jr.
7,069,629 B2 7/2006 Burgess et al.
7,121,924 B2 10/2006 Fritz et al.
7,169,199 B2 1/2007 Barber, Jr. et al.
7,189,784 B2 3/2007 Barber, Jr.
7,393,371 B2 * 7/2008 O'Gary ..... B24D 3/002 51/293
7,427,574 B2 * 9/2008 Allen ..... D04H 1/46 15/210.1
7,754,041 B2 * 7/2010 Fox et al. ..... 156/181
7,811,342 B1 10/2010 Hsu
7,985,269 B2 * 7/2011 Ludwig ..... B24D 3/28 51/293
2002/0014040 A1 * 2/2002 Vincent ..... B24D 3/28 51/298
2003/0114078 A1 * 6/2003 Mann ..... 451/28
2004/0121689 A1 * 6/2004 Anderson et al. ..... 442/334
2005/0042976 A1 * 2/2005 Ronay ..... 451/41
2006/0264142 A1 * 11/2006 Wenstrup ..... D04H 13/00 442/415
2007/0026754 A1 * 2/2007 Martin Rivera ..... A47L 17/08 442/402
2007/0079462 A1 * 4/2007 Haskett ..... A47L 13/04 15/229.11
2008/0026659 A1 * 1/2008 Brandner et al. ..... 442/327
2008/0127572 A1 6/2008 Ludwig
2008/0236722 A1 * 10/2008 Charbonneau ..... C03B 37/045 156/74
2012/0231691 A1 * 9/2012 Peyras-Carratte ..... B32B 5/22 442/372

OTHER PUBLICATIONS

Glossary (Grinding Technology) , Apr. 10, 2003 , http://www.abrasiveengineering.com/glossary.htm.*
International Search Report for PCT/US2012/044743 filed Jun. 28, 2012.
Kamath, M.G., et al., "Needle Punched Nonwovens", Updated: Apr. 2004, 8 pages. <http://www.engr.utk.edu/mse/Textiles/Needle%20Punched%20Nonwovens.htm>.
3M Scotch-Brite, "Surface Conditioning Wheels: Convolute, Unitized and Molded Wheels", 17 pages.
Norton Saint-Gobain, Discs Catalog—Paper Discs, Cloth Discs, Flap Discs, Fibre Discs, Rapid Strip, Spirabands, Locking Discs and Surface Finishing Discs, pp. 20-27.
Norton Saint-Gobain, "Discs—Rapid Strip", Features & Benefits, 1 page. <http://www.nortonconsumer.com/Discs-RapidStrip.aspx>.
Norton Saint-Gobain, "Non-Woven Abrasives—Unified Wheels" 3 pages.
Norton Saint-Gobain, "How-to Articles", 3 pages.
Supplementary European Search Report for EP12803628 dated Jun. 8, 2015, 1 pg.

* cited by examiner

NONWOVEN ABRASIVE ARTICLE WITH EXTENDED LIFE

FIELD OF THE DISCLOSURE

This disclosure, in general, relates to a non-woven single layer abrasive comprising abrasive particles.

BACKGROUND

Abrasive articles, such as coated abrasives and bonded abrasives, are used in various industries to machine work pieces, such as by lapping, grinding, or polishing. Machining utilizing abrasive articles spans a wide industrial scope from optics industries, automotive paint repair industries, to metal fabrication industries. In each of these examples, manufacturing facilities use abrasives to remove bulk material or affect surface characteristics of products.

Surface characteristics include shine, texture, and uniformity. For example, manufacturers of metal components use abrasive articles for cleaning, deburring, blending, and polishing surfaces. Abrasive articles are also used for coating removal. For example, abrasive products used for these applications have their limitation in terms of useful life. As such, an improved abrasive product would be desirable.

SUMMARY

In a particular embodiment, an abrasive article includes a single layer material. The single layer material includes a non-woven web of staple fibers. The non-woven web contains abrasive particles, which are bound to the non-woven web.

In an embodiment, a compressed abrasive article includes a single layer of non-woven web. The non-woven web includes staple fibers. The staple fibers may comprise a blend of a first portion of fibers having a first linear density and a second portion of fibers having a second linear density. The non-woven web further includes a binder and abrasive particles. The compressed abrasive article further has a compression ratio of at least about 10%.

In another embodiment, a method for making an abrasive article includes blending at least two portions of staple fibers and forming a fiber web. The method further includes mixing the fiber web with grains to yield an abrasive web. Moreover, the method includes saturating the abrasive web with a saturation formulation and compressing the saturated abrasive web, wherein the method includes curing the saturated abrasive web during the compressing to form an abrasive article.

BRIEF DESCRIPTION OF THE DRAWINGS

The present disclosure may be better understood, and its numerous features and advantages made apparent to those skilled in the art by referencing the accompanying drawings.

DETAILED DESCRIPTION

In a particular embodiment, an abrasive article can include a single layer material. The single layer material can include a non-woven web of staple fibers. The non-woven web can contain abrasive particles, which are bound to the non-woven web.

Figure 1:
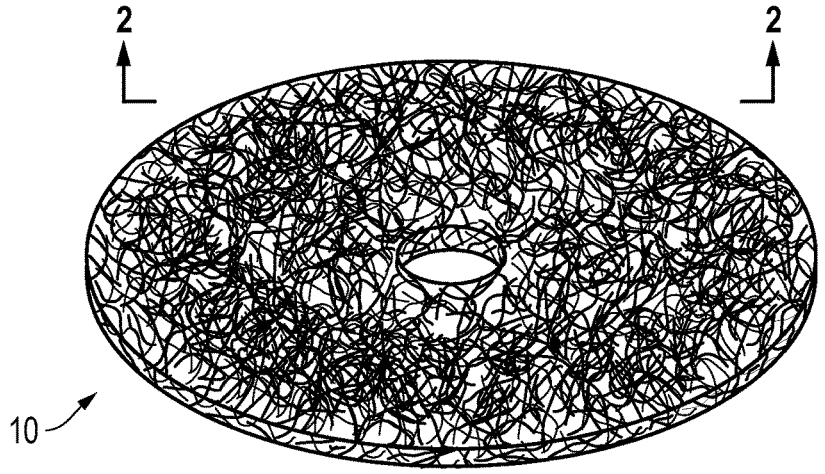
FIG. 1 includes an illustration of an exemplary abrasive article.

FIG. 1 illustrates an abrasive article 10. The abrasive is in the form of a disc. Disc 10 includes a single layer, non-woven web and abrasive particles (not shown in FIG. 1) which are adhered to the non-woven web by a binder or adhesive (not shown in FIG. 1).

Figure 2:
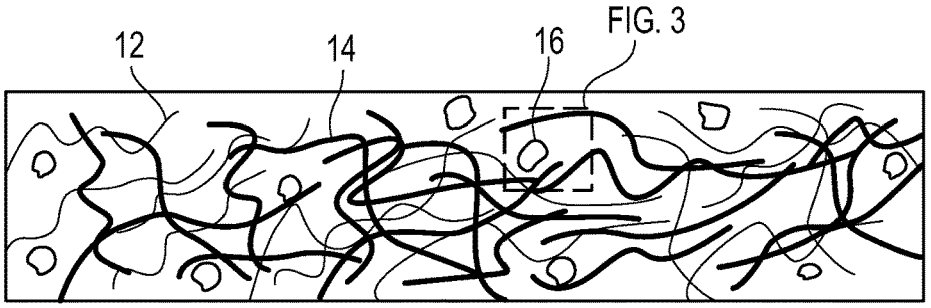
FIG. 2 includes a cross-sectional view of the exemplary abrasive article.

FIG. 2 is a cross-sectional view of abrasive article 10. The single layer, non-woven web is a non-woven web of staple fibers 12 and 14. The staple fibers can be natural fibers or polymer fibers. In an embodiment, the natural fiber can be chosen from a kenaf fiber, a hemp fiber, a jute fiber, a flax fiber, a sisal fiber, or any combination thereof. In another embodiment, the polymer fiber can be chosen from a polyamide, a polyimide, a polyester, a polypropylene, a polyethylene, or a combination thereof. In FIG. 2, the staple fibers also include a blend of staple fibers. In an embodiment, the blend includes staple fibers of different origin, such as a blend of natural and polymer fibers. In another embodiment, the blend can include a blend of different natural fibers, such as a blend of kenaf fibers and flax fibers. In yet another embodiment, the blend can include a blend of different polymer fibers, such as a blend of polyamide fibers and polyester fibers. In even another embodiment, the blend can include a blend of different polyamide fibers. For example, polyamide fibers can be selected from nylon fibers or aramid fibers. Nylon fibers can be nylon-6 or nylon-6,6. A blend of different polyamide fibers can include a blend of nylon-6 and nylon-6,6 fibers. The blend can include two or more types of different type of fibers. For example, the blend can include two or more natural fibers and one or more polymer fibers. In another embodiment, the blend can include three or more polymer fibers.

Each type of staple fibers can be present in any portion from about 1 wt % to about 99 wt %, such as about 5 wt %, about 10 wt %, about 20 wt %, about 30 wt %, about 40 wt %, about 50 wt %, about 60 wt %, about 70 wt %, about 80 wt %, about 90 wt %, or even about 95 wt %. A blend of two types of staple fibers can have any ratio ranging from about 1:99 to about 50:50, such as about 5:95, about 10:90, about 20:80, about 30:70, or about 40:60. The ratio can be based on weight of the types of fiber or volume.

In even another embodiment, a blend also includes fibers of different physical properties. In an embodiment, a blend can include staple fibers of different linear density. In one embodiment, the blend can include fibers of different composition, i.e. natural and polymer fibers, which can have the same or different linear densities. Linear density is measured in denier. A denier is the mass in grams per 9,000 meters length of a single filament. For example, a nylon fiber having 200 deniers means that 9,000 meter of this fiber weighs 200 grams. In an embodiment, one type of fiber can have a linear density ranging from about 50 deniers to about 1200 denier. In another embodiment, the blend of staple fibers includes one portion of staple fibers having a linear density between of at least about 50 deniers, such as at least about 60 deniers, at least about 80 deniers, at least about 100 deniers, at least about 200 deniers, at least about 250 deniers, at least about 300 deniers, at least about 320 deniers, at least about 350 deniers, or at least about 400 deniers. In another embodiment, the blend of staple fibers includes one portion of staple fibers having a linear density not greater than about 250 deniers, such as not greater than about 280 deniers, not greater than about 300 deniers, not greater than about 400 deniers, not greater than about 500 deniers, not greater than about 600 deniers, not greater than about 800 deniers, not greater than about 900 deniers, not greater than about 1000 deniers, or not greater than about 1200 deniers.

In another embodiment, the blend includes a bimodal blend of staple fibers. One portion of the staple fibers has a first modus of averaged linear density. A second portion of staple fibers has a second modus of averaged linear density. The difference of the maxima of the first modus and the second modus can be at least about 50 deniers, at least about 75 deniers, at least about 100 deniers, at least about 125 deniers, at least about 150 deniers, at least about 175 deniers, at least about 200 deniers, at least about 225 deniers, at least about 250 deniers, at least about 275 deniers, at least about 300 deniers, at least about 325 deniers, at least about 350 deniers, at least about 375 deniers, at least about 400 deniers, at least about 425 deniers, at least about 450 deniers, at least about 475 deniers, or at least about 500 deniers.

Still referring to FIG. 2, staple fibers 12 have a different linear density than staple fiber 14. In an embodiment, fibers 12 can have a linear density ranging from about 50 deniers to about 400 deniers, such as from about 60 deniers to about 350 deniers, or about 80 deniers to about 300 deniers. In another embodiment, fibers 14 can have a linear density ranging from about 250 deniers to about 1200 deniers, such as from about 300 deniers to about 1100 deniers, or about 320 deniers to about 1000 deniers.

In one embodiment, the non-woven web can be densified. Densification can be achieved by needle punching, carding, hydroentangling, or a combination thereof.

FIG. 2 also depicts abrasive particles 16. The abrasive particles can be selected from an alumina, a silicon carbide, a boron carbide, a boron nitride, a diamond, an agglomerated grain, and any combination thereof. The term "agglomerated grain" refers to three-dimensional granules comprising abrasive grain and a binding material, the granules having at least 35 volume % porosity. Unless filamentary grains are described as making up all or part of the grain in the granules, the agglomerated abrasive grain granules consist of blocky or sphere-shaped abrasive grain having an aspect ratio of about 1.0. The agglomerated abrasive grain granules are exemplified by the agglomerates described in U.S. Pat. No. 6,679,758 B2, titled Porous Abrasive Articles with Agglomerated Abrasives, issued to Bright et al. on Jan. 20, 2004, which is incorporated by reference herein in its entirety.

In one embodiment, the abrasive particles can be distributed homogenously in the non-woven web. In another embodiment, the abrasive particles can be applied to one side of the non-woven web and therefore, be more concentrated on such side. In another embodiment, the abrasive particles can be applied to one side of the non-woven web and subsequently applied to the opposite surface of the non-woven web, wherein a higher concentration of particles is on the surfaces rather the center of the web.

The abrasive particles can have an average grain size ranging from about 24 grit to about 150 grit according to the U.S. Coated Abrasive Manufactures Institute ("CAMI") grading system. In another embodiment, the abrasive particles can have an average grain size from about 30 grit to about 120 grit. In yet another embodiment, the abrasive particles can have an average grain size from about 36 grit to about 100 grit. In another embodiment, the abrasive particles have an average grain size of at least about 93 microns, at least about 116 microns, or at least about 141 microns. In yet another embodiment, the abrasive particles have an average grain size not greater than about 715 microns, not greater than about 745 microns, or not greater than about 764 microns. The abrasive particles can have a Mohs hardness of at least about 8.0, such as at least about 8.5, even at least about 9.0

In one embodiment the abrasive particles can be surface treated. In one embodiment, the abrasive are silylated. In another embodiment, the surface treatment can be done by a coupling agent. The coupling agent can be a silane containing coupling agent selected from an aminoalkylsilane, an isocyanatosilane, a chloroalkysilane, or any combination thereof.

Figure 3:
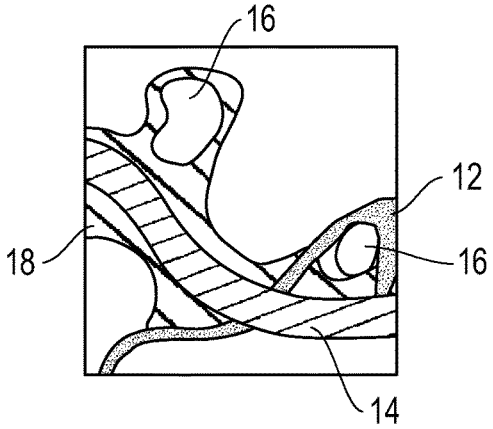
FIG. 3 includes a detailed view of a cross-section of the abrasive article.

FIG. 3 further depicts a detailed cut-out of the cross-section of FIG. 2. Polymeric binder 18 binds staple fibers 12 and 14 with abrasive particles 16. Polymeric binder 18 can include a curable polymeric binder. The curable polymeric binder 18 can include organic polymers selected from a polyvinylpyrrolidone, a polyacrylic acid, a polyacrylate, a polymethacrylic acid, a polymethacrylate, a polystyrene, a polyvinyl alcohol, a polyvinyl acetate, a polyacrylamide, a cellulose, a polyether, a phenolic resin, a melamine resin, a polyurethane, a polyurea, a polyester, a phenoxy, a latex, a fluorinated polymer, a chlorinated polymer, a siloxane, a silyl compound, a silane, and any combination thereof. Further, the curable polymeric binder can include a blocked resin. Polymeric binder 18 can be a strong and flexible polymeric binder. Polymeric binder 18 can hold the non-woven web together during abrading while allowing the support to be flexible enough to conform to the shape of the work piece.

In an embodiment, the polymeric binder 18 can be formed from saturation formulations that can further include components such as dispersed filler, solvents, plasticizers, chain transfer agents, catalysts, stabilizers, dispersants, curing agents, reaction mediators, or agents for influencing the fluidity of the dispersion. In addition to the above constituents, other components can also be added to the saturation formulation, including, for example, anti-static agents, such as graphite, carbon black, and the like; suspending agents, such as fumed silica; anti-loading agents, such as metal stearate, including lithium, zinc, calcium, or magnesium stearate; lubricants such as wax; wetting agents; dyes; fillers, such as calcium carbonate, talc, clay and the like; viscosity modifiers such as synthetic polyamide wax; defoamers; or any combination thereof.

In a particular embodiment, polymeric binder material of polymeric binder 18 can be located between the fibers 12 or 14 and the abrasive particles 16. In an embodiment, polymeric binder 18 can overlie the abrasive particles 16. In another embodiment, abrasive particles can be bound to the non-woven web with an adhesive. The adhesive can be selected from an epoxy adhesive, a polysulfide adhesive, a polyurethane adhesive, a phenolic adhesive, a polyester adhesive, a polyvinyl butyral adhesive, a polyolefin adhesive, a vinyl ester adhesive, or a combination thereof.

Figure 4:
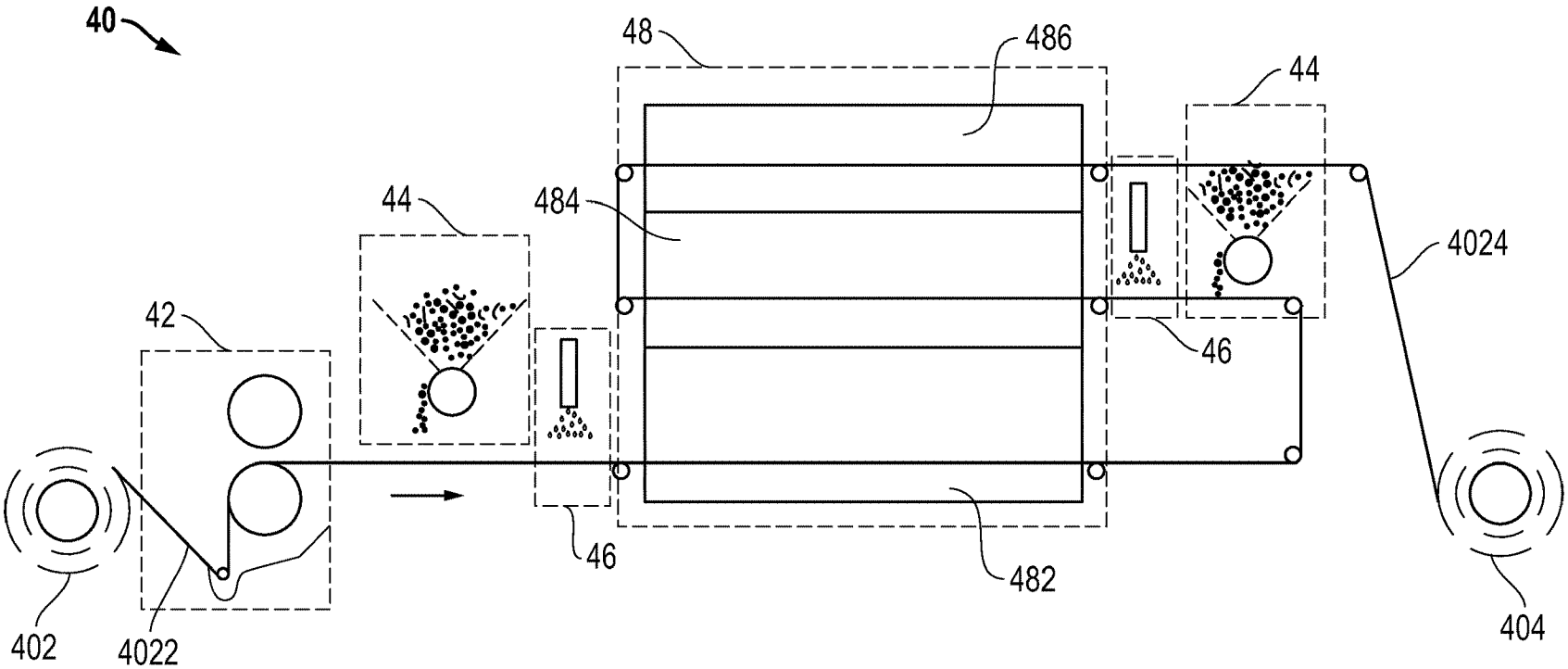
FIG. 4 includes an illustration of a process scheme for making an abrasive article.

FIG. 4 depicts one option for a process 40 for applying grains to a single layer non-woven web of staple fibers. The single layer non-woven web 4022 is rolled from roll 402 and is saturated with a saturation formulation. The saturation solution contains a polymer resin and can further contain a curing agent and/or a lubricant. The polymer resin can be selected from a phenolic resin, a melamine resin, a polyurethane resin, a polyuria resin, a polyester resin, a phenoxy resin, a latex resin, an epoxy resin, or a combination thereof. The curing agent can be any conventional agent that initiates, catalyzes, or otherwise promotes the curing of the polymer resin. The lubricant can be any conventional lubricant. In embodiments, the lubricants can be a wax, a fatty acid, or a fatty acid salts. In one embodiment, the lubricant can be an alkali stearate, such as lithium stearate. The saturation can be accomplished by a dip and squeeze process as depicted in element 42 of FIG. 4. Onto one side of the saturated non-woven web abrasive particles are applied as shown in element 44 of FIG. 4, followed by a spray application of adhesive as shown in element 46. The partially treated web is cured in one run through the lowest level 482 of three-stage oven 48. Upon exiting the oven the partially treated web is turned and the opposite side is treated with abrasives (44) and sprayed with adhesive (46) followed by two runs through mid-level 484 and third-level 486 of oven 48 before the uncompressed abrasive non-woven web 4024, i.e., the non-woven web containing abrasive particles is rolled onto roll 404.

Figure 5:
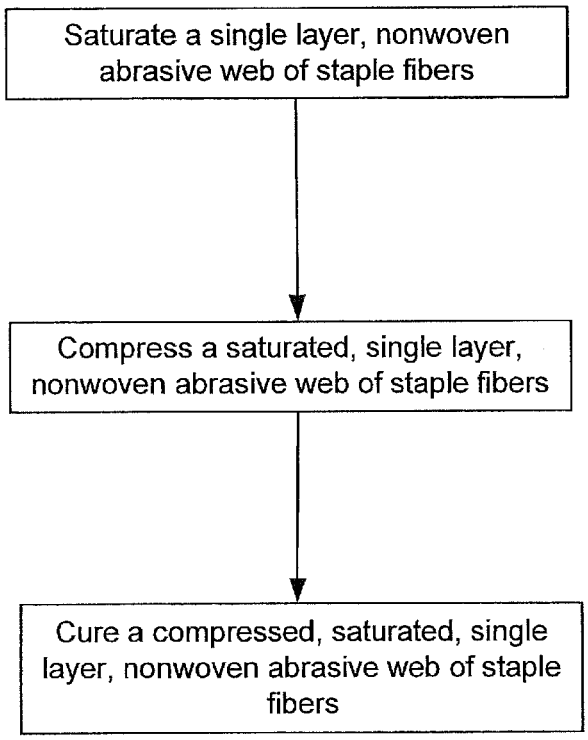
FIG. 5 includes an illustration of some method steps for making an abrasive article.

In a particular embodiment, the abrasive article is compressed. FIG. 5 depicts the method steps for preparing a compressed abrasive article. A saturated single layer of non-woven web of staple fibers containing abrasives as depicted in FIGS. 2 and 3 is saturated with saturation solution contains a polymer resin and can further contain a curing agent and/or a lubricant. The polymer resin can be selected from a phenolic resin, a melamine resin, a polyurethane resin, a polyuria resin, a polyester resin, a phenoxy resin, a latex resin, or a combination thereof. The curing agent can be any conventional agent that initiates, catalyzes, or otherwise promotes the curing of the polymer resin. The lubricant can be any conventional lubricant. In embodiments, the lubricants can be a wax, a synthetic paraffin, a fatty acid, a fatty acid salts, or Teflon powder. In one embodiment, the lubricant can be an alkali stearate, such as lithium stearate.

Still referring to FIG. 5, the saturated, single layer of non-woven abrasive web is then compressed. Compression can be done, for example by pressing slabs of the saturated, single layer of non-woven abrasive web between metal plates to a desired thickness. In embodiments, the thickness of the compressed, saturated, single layer of non-woven abrasive web can be about ¼ inch, about 1 cm, about ½ inch, about 1.5 cm, about 2.0 cm, or about 1 inch thick. In other embodiments, the compression can be expressed in compression ratio. The compression ratio is the result of 1−(d(compressed)/d(uncompressed)) expressed in percentage, wherein d(compressed) and d(uncompressed) designate the thickness or density in $g/cm^3$ of the compressed or uncompressed abrasive article. Compression achieves its completion by curing the compressed, saturated, single layer of non-woven abrasive web, i.e., during curing the metal plates hold the slab of web in place.

In an embodiment, the compression ratio can be at least about 10%. In another embodiment, the compression ratio can be at least about 20%. In yet another embodiment, the compression ratio can be at least about 50%. In another embodiment, the compression ratio is not greater than about 90%.

In an embodiment, the abrasive article can have a hardness of 20 $kg_f$/25% compression to 90 $kg_f$/25% compression, such as 30 $kg_f$/25% compression to 80 $kg_f$/25% compression, even 40 $kg_f$/25% compression to 70 $kg_f$/25% compression as measured by applying a force with a 25.4 mm semi-spherical probe to compress the abrasive article by 25% along the thickness direction. In a particular embodiment, the hardness can be 50 to 60 $kg_f$/25% compression.

The G-Ratio is the ratio of the amount of material removed to the amount of abrasive wheel wear. Sample abrasive wheels having a thickness of 6.35 mm are cut to 76 mm outer diameter and 6.35 mm inner diameter. A metal plate (Aluminum) is subjected to grinding by the sample discs. Grinding is performed with the sample discs held perpendicular to the surface so that the full thickness of the sample disc is in contact with the metal plate and is positioned to avoid edge grinding. A 0.9 kg load is used to force the disc against the metal plate. The plate is ground for five 1 minute cycles with a 15 second cooling period between each cycle.

In an embodiment, the G-ratio of an abrasive article or a compressed abrasive article according to the invention is at least about 10. In another embodiment, the G-ratio is at least about 15. In yet another embodiment, the G-ratio is at least about 19.

Turning to the method of forming the abrasive article, a single layer of non-woven web comprising a blend of two or more portion of staple fibers can be provided. For example, the blend of staple fibers can be deposited randomly and bound together with a polymeric binder, such as an acrylic or polyurethane latex. In an embodiment the blend can fiber of different linear density. The difference of linear density can be about 100 deniers, about 200 deniers, about 300 deniers, or about 400 deniers. In an example, between 200 $g/m^2$ and 800 $g/m^2$ of blend of staple fibers can be used. The web can be needle punched, carded, or hydroentangled. A binder formulation containing a binder resin can be applied and the binder treated can be cured to form a semi-finished non-woven web. In an embodiment, the semi-finished non-woven web can have a thickness of at least about ½ inch, such as at least about 1.5 cm, even at least about 2.0 cm. Further, the non-woven layer can have a weight between about 400 $g/m^2$ and about 700 $g/m^2$.

A first saturation with a first saturation formula can be applied to the non-woven layer. The first saturation formula can include a curable binder, such as a polyurethane resin, a phenoxy resin, polyester resin, or any combination thereof. The binder can be blocked to substantially prevent curing without the application of heat. The first saturation can be applied by immersing the support into the first saturation formula. After immersion, the non-woven layer can be squeezed to remove excess binder resin.

Abrasive particles can be applied to the saturated non-woven layer, such as by dropping the abrasive particles onto the support or projecting the abrasive particles into the non-woven layer. For example, from 500 $g/m^2$ to 2000 $g/m^2$ can be dropped onto the non-woven layer per side of the layer to distribute the abrasive grains throughout the layer. An adhesive can be applied overlying the abrasive particles, such as by spraying, and the adhesive can be dried. The adhesive can serve to retain the abrasive particles during subsequent processing. In an alternative embodiment, the abrasive particles and the saturation formula can be combined in a slurry and applied together and the second polymeric binder may be absent.

In an embodiment, a second saturation and of the saturation formula can be applied. The second saturation can be applied by immersing the support into the saturation formula. After immersion, the non-woven can be squeezed to remove excess binder. In yet another embodiment, a second load of abrasive particles and a second application of adhesive can be undertaken, followed by drying and curing the adhesive and binder of the saturation formula in an oven. The resulting non-woven abrasive web can have a weight between 1 kg/m$^2$ and 3 kg/m$^2$.

The non-woven abrasive web can then be compressed. Compression begins with saturating slabs of the non-woven abrasive web in a saturation formula. Saturation can be done by a dip and squeeze process on a two-roll coater. Slabs can be squares having a side length of at least 30 cm, at least 35 cm, at least 40 cm, or at least 50 cm. The slabs can be placed between two metal plates and compressed to a desired thickness. The compressed slabs are cured in an oven.

EXAMPLES

Sample disc 1 and 2 are prepared from a blend of staple nylon fiber comprising 50 wt % of 500 denier nylon fiber having a staple length of about 2.5 inches and 50 wt % of 200 denier nylon fiber having a staple length of about 2.0 inches. The blend has a weight of about 530 g/m$^2$. The web is further needle punched in a needle loom. A binder is applied onto the blend. The binder formulation includes about 59.3% water, 1.5% melamine resin (a partially methylated melamine resin from Momentive Specialty Chemicals Inc.), 0.2% Triton 100X (a nonionic, octylphenol ethoxylate surfactant from The Dow Chemical Company) and 39.0% Hycar 26138 (an heat reactive acrylic latex from Lubrizol Advanced Materials Inc.). The binder formulation is sprayed on one side of the blend and cured on level 1 of a three stage oven. After curing, the binder is sprayed on the opposite side and the blend is cured through levels 2 and 3 of the three stage oven. The resulting non-woven web has a weight of about 590 g/m$^2$ a width of about 1.34 m and a thickness of about 2.3 cm. In an embodiment, the binder application followed by curing can be repeated.

The non-woven web is saturated by a dip and squeeze process with a polyurethane resin mix. The polyurethane resin mix includes 56% polyurethane resin (BLM500, a MDI based rethane prepolymer with blocked isocyanate curint sites from Chemtura Corporation), 6.0% of a curative (Ancamine DL-50 from Air Products), 30.5% methylisobutylketone (solvent), 3.5% lithium stearate (an anti-loading lubricant from Chemtura) and 4% of colorant.

Abrasive grains in form of agglomerate of aluminum oxide at an average grain size of 60 grit or 100 grit are dropped by gravity on one side of the saturated non-woven web from a hopper at about 800 g/m$^2$. After that binder is sprayed onto the side. The binder formulation includes 56% water, 6.0% Hycar 26138 (acrylic latex), 3.5% Triton X100 (surfactant), and 2.5% colorant. The material passes through level 1 of a three stage curing oven. On a second level, before entering the oven into level 2, the opposite is treated with abrasive grains in form of agglomerate of aluminum oxide at an average grain size of 60 grit or 100 grit by gravity and fixated with binder. The material returns into the oven on level 2 and level 3 for curing. In embodiments, the abrasive grain application, binder fixation, and curing can be repeated. The abrasive non-woven web has a width of 1.43 m, a thickness of 2.3 cm, and a weight of about 2.71 kg/m$^2$. The abrasive non-woven web is cut into slabs of 43×43 cm.

The slabs are saturated in a polyurethane resin mix by a dip and squeeze process. The saturation formula includes 66% polyurethane resin (BLM500), 7.0% of a curative (Ancamine DL-50), 17% methylisobutylketone (solvent), 4.3% lithium stearate (lubricant) and 5.7% of colorant. The saturated slabs can be stacked and compressed between two metal plates to a thickness of 0.63 cm (compression ratio 73%). The racks are placed in an oven and cured for 18 hours at ramp from 126° C. to 99° C., while air is forced through the racks to improve heat transfer and removal of volatile chemicals.

The metal plates are removed, the slabs are separated and further processed to a commercial product, such as abrasive discs. Sample 1 containing 100 grit aluminum oxide agglomerate are medium abrasive discs. Sample 2 containing 60 grit aluminum oxide agglomerate are coarse abrasive discs

Example 1: Performance

Samples are tested to determine cut rate, wheel wear, and G-Ratio. The G-Ratio is the ratio of the amount of material removed to the amount of wheel wear. Sample wheels having a thickness of 6.35 mm are cut to 76 mm outer diameter and 6.35 mm inner diameter. A metal plate such as aluminum or stainless steel is subjected to grinding by the sample discs. Grinding is performed with the sample discs held perpendicular to the surface so that the full thickness of the sample disc is in contact with the metal plate and is positioned to avoid edge grinding. A 0.9 kg load is used to force the disc against the metal plate. The plate is ground for five 1 minute cycles with a 15 second cooling period between each cycle. The wheel is rotating at 9,000 rpm. The cut rate is determined from the difference in the weight of the plate before and after grinding. The wheel wear is determined from the difference in the weight of the wheel before and after grinding. Table 1 summarizes the performance values for sample 1 (medium abrasive discs, also designated Vortex RB MED), sample 2 (coarse abrasive discs, also designated Vortex RB CRS) compared to a commercial product from 3M, 3M SC CRS Surface Conditioning Disc on aluminum.

TABLE 1

| | Material Removed/g | Wheel Wear/g | G-Ratio | End of Life/min |
|---|---|---|---|---|
| Vortex RB MED | 42.28 | 2.72 | 15.5 | 110 |
| Vortex RB CRS | 71.43 | 3.71 | 19.3 | 180 |
| 3M SC CRS | 16.01 | 1.81 | 8.8 | 45 |

Sample 1 and Sample 2, i.e. Vortex RB MED and Vortex RB CRS, show better performance with a cut rate (material removed) of more than twice the cut of the 3M product and a life time that exceeded the life of the 3M product by factor 2.5 for the sample 1 and by factor 4 for sample 2.

Figure 6:
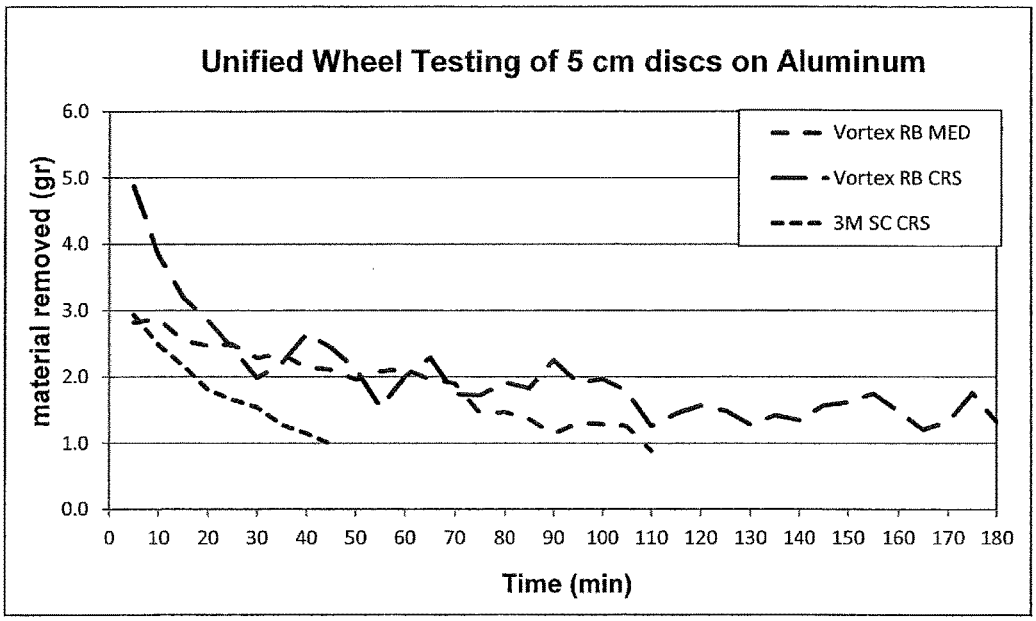
FIGS. 6 through 8 include illustrations of results from test performances of abrasive articles The use of the same reference symbols in different drawings indicates similar or identical items.

FIG. 6 depicts the cut rate into aluminum of sample 1 (Vortex RB MED), sample 2 (Vortex RB CRS), and 3M SC CRS as function of time. In any given time interval the cut of samples 1 and 2 are superior to the cut of the 3M product. Moreover, during the lifetime of the 3M product, i.e. within the first 45 minutes, both Vortex discs have cut more material than the 3M product. This shows that the Vortex product is not only superior to the 3M product due to an extended lifetime but also due to an inherently higher quality.

Figure 7:
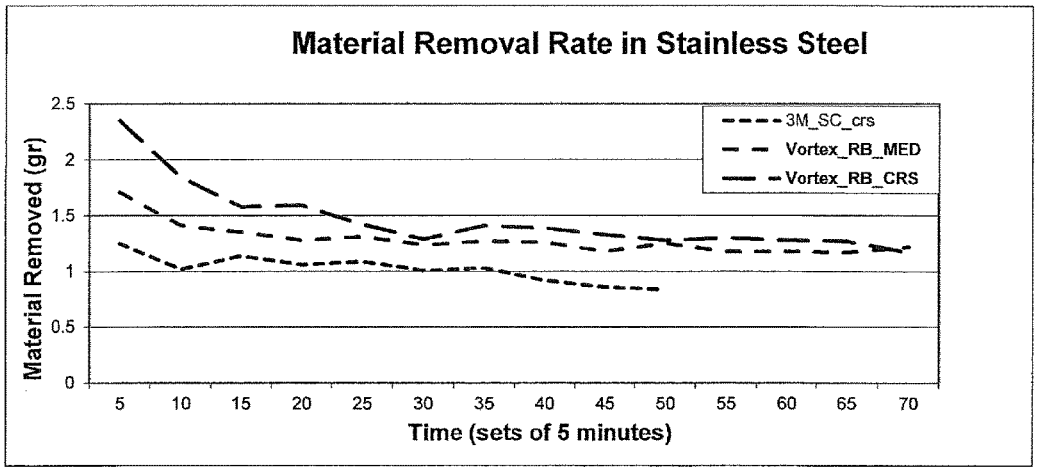

FIG. 7 depicts the cut rate into stainless steel of sample 1 (Vortex RB MED), sample 2 (Vortex RB CRS), and 3M SC CRS as function of time. Even with the harder work piece of stainless steel, in any given time interval the cut of samples 1 and 2 are superior to the cut of the 3M product. During the lifetime of the 3M product, i.e. within the first 50 minutes, both Vortex discs have cut more steel than the 3M product. This shows that the Vortex product is not only superior to the 3M product with respect to soft material such as aluminum but also to hard material such as steel.

Figure 8:
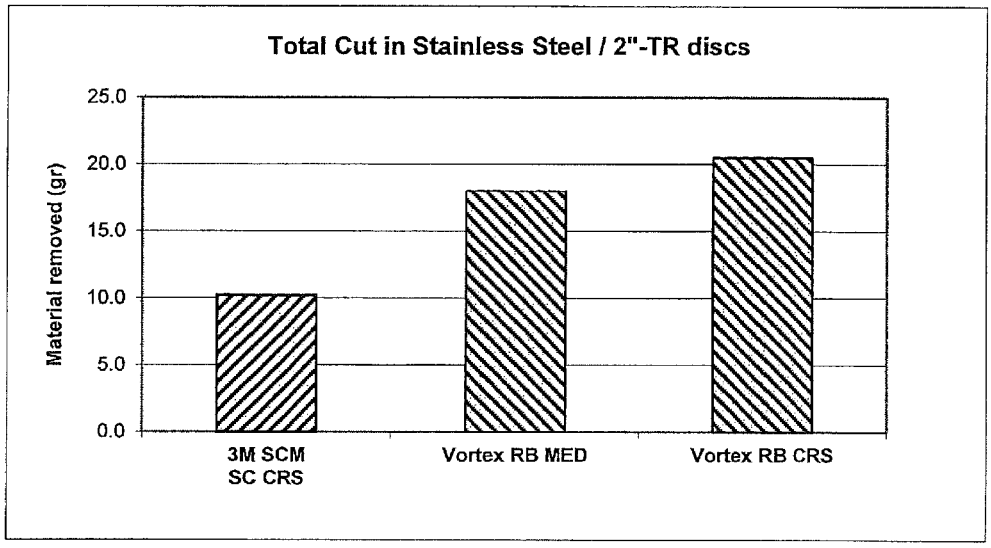

FIG. 8. depicts the total stainless steel cut rate of the three discs. The Vortex RB MED disc has about 78% higher performance and the Vortex RB CRS has over 100% better performance than the commercial 3M product.

An abrasive article includes a non-woven web of staple fibers. The non-woven web of staple fibers can form a single layer that is free of any additional layers of non-woven webs of staple fibers. The non-woven web further comprises abrasive particles bound to the non-woven web. In one embodiment, the non-woven web further includes a binder. In another embodiment, the binder can be composed of organic polymers selected from a polyvinylpyrrolidone, a polyacrylic acid, a polyacrylate, a polymethacrylic acid, a polymethacrylate, a polystyrene, a polyvinyl alcohol, a polyvinyl acetate, a polyacrylamide, a cellulose, a polyether, a phenolic resin, a melamine resin, a polyurethane, a polyurea, a polyester, a phenoxy, a latex, a fluorinated polymer, a chlorinated polymer, a siloxane, a silyl compound, a silane, or any combination thereof.

In another embodiment of the abrasive article, the non-woven web can include a blend of staple fibers. The blend can include a first portion of staple fibers having a linear density of at least about 80 deniers and not greater than about 300 deniers, such as between about 100 deniers and about 250 deniers, such as between about 125 deniers and about 250 deniers, such as between about 150 deniers and about 225 deniers, such as between about 180 deniers and about 220 deniers. The blend can further include a second portion of staple fibers having a linear density of at least about 320 deniers and not greater than about 1000 deniers, such as between about 350 deniers and about 800 deniers, such as between about 400 deniers and about 600 deniers, such as between about 450 deniers and about 550 deniers.

In another embodiment of the abrasive article, the blend includes a bimodal blend of staple fibers, wherein a first modus is a first portion of staple fibers having a first linear density and a second modus is a second portion of staple fibers having a second linear density, wherein the difference of the maxima between the first modus and the second modus is at least 50 deniers. In another embodiment, the difference between the first modus and the second modus is at least 100 deniers, such as at least 150 deniers, such as at least 200 deniers, such as at least 250 deniers, such as at least 300 deniers, such as at least 350 deniers, such as at least 400 deniers, such as at least 450 deniers, such as at least 500 deniers.

In one embodiment of the abrasive article, the blend includes a first portion and a second portion of staple fibers in a ratio ranging from about 5:95 to about 95:5. In an embodiment, the ratio is ranging from about 20:80 to about 80:20. In another embodiment, the ratio is ranging from about 30:70 to about 70:30. In yet another embodiment, the ratio is ranging from about 40:60 to about 60:40. In another embodiment, the ratio is about 40:60. In yet another embodiment, the ratio is about 50:50. In yet another embodiment, the ratio is about 60:40.

In one further embodiment, the non-woven web is densified. In another embodiment, the abrasive article has staple fibers that include a polyamide, a polyimide, a polyester, a polypropylene, a polyethylene, a kenaf fiber, a hemp fiber, a jute fiber, a flax fiber, or a sisal fiber, or any combination thereof. In another embodiment, the polyamide is selected from a nylon, an aramid, or a combination thereof. In yet another embodiment, the nylon is selected from nylon-6; nylon-6,6; or a combination thereof.

In one other embodiment of the abrasive article, the abrasive particles are distributed homogenously in the non-woven web. The abrasive particles have an average grain size ranging from about 24 grit to about 150 grit of the U.S. Coated Abrasive Manufacturers Institute grading system. In another embodiment, the abrasive particles have an average grain size of at least about 93 microns, at least about 116 microns, or at least about 141 microns. In yet another embodiment, the abrasive particles have an average grain size of not greater than about 715 microns, not greater than about 745 microns, or not greater than about 764 microns.

In a further embodiment of the abrasive article, the abrasive particles are selected from an alumina, a silicon carbide, a boron carbide, a boron nitride, a diamond, an agglomerated grain, or any combination thereof. In one embodiment, the abrasive particles are silylated.

In an embodiment, the abrasive particles are bound to the non-woven web by an adhesive. The adhesive is selected from an epoxy adhesive, a polysulfide adhesive, a polyurethane adhesive, a phenolic adhesive, a polyester adhesive, a polyvinyl butyraladhesive, a polyolefin adhesive, or a vinyl ester adhesive.

In one embodiment, the abrasive article, the single layer material is compressed with a compression ratio of at least about 10%. The compression rate is the difference of the thicknesses of the uncompressed and the compressed article divided by the thickness of the uncompressed article. In another embodiment, the compression ratio is at least about 20%. In another embodiment, the compression ratio is at least about 50%. In yet another embodiment, the compression ratio is not greater than about 90%.

In one embodiment of the abrasive article, the single layer material has a G-ratio of at least about 10. The G-ratio is the ratio of the mass of cut material of a work piece, such as aluminum or stainless steel over the mass of the material worn off the single layer. In another embodiment, the G-ratio is at least about 15. In a further embodiment, the G-ratio is at least about 17. In yet another embodiment, the G-ratio is at least about 19.

A compressed abrasive article includes a non-woven web of staple fibers. The staple fibers comprise a blend of a first portion of fibers having a first linear density and a second portion of fibers having a second linear density. The compressed abrasive article further includes a binder and abrasive particles. In an embodiment, the blend can be a bimodal blend and the difference of maxima between the linear densities of the first portion and the second portion is at least about 50 deniers, such as about 75 deniers, such as about 100 deniers, such as about 125 deniers, such as about 150 deniers, such as about 175 deniers, such as about 200 deniers, such as about 250 deniers, such as about 300 deniers, such as about 350 deniers, such as about 400 deniers, such as about 450 deniers, such as about 500 deniers.

The compressed abrasive article has a compression ratio of at least about 10%. In another embodiment, the compression ratio is at least about 20%. In yet another embodiment, the compression ratio is at least about 50%. In yet another embodiment, the compression ratio is not greater than about 90%.

In one embodiment, the compressed abrasive article has staple fibers that include a polyamide, a polyimide, a polyester, a polypropylene, a polyethylene, a kenaf fiber, a hemp fiber, a jute fiber, a flax fiber, a sisal fiber, or any combination thereof. The polyamide can be selected from a nylon, an aramid, or a combination thereof. In an embodiment, the nylon can be selected from nylon-6; nylon-6,6; or a combination thereof.

In one embodiment, the first portion and the second portion are in a ratio ranging from 30:70 to 70:30. In another embodiment, the ratio is about 40:60. In a further embodiment, the ratio is about 50:50. In yet another embodiment, the ratio is about 60:40.

In an embodiment of the compressed abrasive article, the first linear density ranges from about 80 denier to about 300 denier and the second linear density ranges from about 320 density to about 1000 denier. In another embodiment, the first linear density is about 200 denier and the second linear density is about 500 denier.

In another embodiment of the compressed abrasive article, the binder is composed of organic polymers selected from a polyvinylpyrrolidone, a polyacrylic acid, apolyacrylate, a polymethacrylic acid, a polymethacrylate, a polystyrene, a polyvinyl alcohol, a polyvinyl acetate, a polyacrylamide, a cellulose, a polyether, a phenolic resin, a melamine resin, a polyurethane, a latex, a fluorinated polymer, a chlorinated polymer, a siloxane, a silyl compound, a silane, or any combination thereof.

In an embodiment, the abrasive particles are selected from an alumina, a silicon carbide, a boron carbide, a boron nitride, a diamond, an agglomerated grain, or any combination thereof.

In another embodiment, the compressed abrasive article has a G-ratio of at least about 10. In a further embodiment, the G-ratio can be at least about 15. In yet another embodiment, the G-ratio can be at least about 17. In even one further embodiment, the G-ratio is at least about 19.

A method for making an abrasive article includes blending at least two portions of staple fibers; forming a fiber web; mixing the fiber web with grains to yield an abrasive web; saturating the abrasive web with a saturation formulation; compressing the saturated abrasive web; and curing the saturated abrasive web during the compressing to form an abrasive article.

In one embodiment of the method, the blending can further includes densifying the two or more portions of staple fibers. In one embodiment, densifying can include needle punching, carding, hydroentangling, or a combination thereof.

In one embodiment of the method, each portion of staple fibers can have a linear density ranging from about 80 denier to about 1000 denier and no two linear densities are the same. In an embodiment, the staple fibers can include a polymer selected from a polyamide, a polyimide, a polyester, a polypropylene, a polyethylene, or any combination thereof. The polyamide can be selected from a nylon, an aramid, or combination thereof. The nylon can be selected from nylon-6; nylon-6,6; or a combination thereof.

In another embodiment of the method, the forming of the fiber web can include applying a binder to the blended portions of staple fibers. The binder can be composed of organic polymers selected from a polyvinylpyrrolidone, a polyacrylic acid, apolyacrylate, a polymethacrylic acid, a polymethacrylate, a polystyrene, a polyvinyl alcohol, a polyvinyl acetate, a polyacrylamide, a cellulose, a polyether, a phenolic resin, a melamine resin, a polyurethane, a latex, a fluorinated polymer, a chlorinated polymer, a siloxane, a silyl compound, a silane, or any combination thereof.

In an embodiment, the binder can be applied by spraying the binder onto the blended portions of staple fibers; dipping the blended portions into a binder formulation; dipping the blended portions into a binder formulation and squeezing the blended portions after the dipping; brushing the binder onto the blended portions of staple fibers; or rolling the binder onto the blended portions of staple fibers; or any combination thereof. In one further embodiment, the forming of the fiber web can further include curing the blended portions of staple fibers.

In one further embodiment of the method, the mixing of the staple fibers can include adhering grains to the fiber web with an adhesive. The adhesive can be selected from an epoxy adhesive, a polysulfide adhesive, a polyurethane adhesive, a phenolic adhesive, a polyester adhesive, a polyvinyl butyral adhesive, a polyolefin adhesive, or a vinyl ester adhesive.

In another embodiment of the method, the grains can be selected from an alumina, a silicon carbide, a boron carbide, a boron nitride, a diamond, an agglomerated grain, and any combination thereof. In one embodiment, the grains can be treated with a coupling agent prior to the mixing. The coupling agent can be selected from an aminoalkylsilane, an isocyanatosilane, a chloroalkylsilane, or any combination thereof. In an embodiment, the grains can have an average grain size ranging from about 24 grit to about 150 grit of the U.S. Coated Abrasive Manufacturers Institute grading system. In one other embodiment, the grains can have an average grain size of at least about 93 microns, at least about 116 microns, or at least about 141 microns. In yet one other embodiment, the grains have an average grain size of not greater than about 715 microns, not greater than about 745 microns, or not greater than about 764 microns.

In an embodiment of the method, the saturation formulation includes a polyurethane resin, a polyvinyl resin, a melamine resin, an epoxy resin, a polyester resin, or any combination thereof. In an embodiment, the compressing includes compressing to a compressing ratio of at least about 10%. In another embodiment, the compression ratio is at least about 20%. In yet another embodiment, the compression ratio is at least about 50%. In even one further embodiment, the compression ratio is not greater than about 90%.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

The term "averaged," when referring to a value, is intended to mean an average, a geometric mean, or a median value.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article, comprising:

a non-woven web comprising a bimodal blend of staple fibers bound together by a first polymer binder, the non-woven web forming a single layer that is free of any additional layers of non-woven webs;

a second polymer binder dispersed throughout the non-woven web, wherein the second polymer binder comprises a polyurethane; and abrasive particles bound to the non-woven web by a third polymer binder, wherein the bimodal blend of staple fibers comprises:

a first portion of staple fibers having a first averaged linear density of at least 80 deniers and not greater than 300 deniers;

a second portion of staple fibers having a second averaged linear density of at least 320 deniers and not greater than 1000 deniers, wherein a difference between maxima of the first averaged linear density and the second averaged linear density is at least 100 deniers, wherein the first portion of staple fibers and the seconds portion of staple fibers are in a ratio ranging from about 30:70 to about 70:30, and wherein the first portion of staple fibers and the second portion of staple fibers comprise a polyamide.

2. The abrasive article according to claim 1, wherein the difference between maxima of the first averaged linear density and the second averaged linear density is at least 150 deniers.

3. The abrasive article according to claim 1, wherein the abrasive particles are silylated.

4. The abrasive article according to claim 1, wherein the third polymer binder is an adhesive.

5. A compressed abrasive article comprising:

a non-woven web comprising a bimodal blend of staple fibers bound together by a first polymer binder;

a second polymer binder dispersed throughout the non-woven web; and abrasive particles bound to the non-woven web by a third polymer binder, wherein the non-woven web comprises:

a first portion of staple fibers having a first averaged linear density and a second portion of staple fibers having a second averaged linear density, wherein the difference between maxima of the first averaged linear density and the second averaged linear density is at least 200 deniers, wherein the first portion of polymer staple fibers have a linear density of at least 100 deniers and not greater than 250 deniers, wherein the second portion of polymer staple fibers have a linear density of at least 400 deniers and not greater than 800 deniers, wherein the first portion of staple fibers and the second portion of staple fibers comprise the same type of polymeric material, wherein the non-woven web comprises a compression ratio of at least about 70%, and wherein the compressed abrasive article has a G-ratio on aluminum of at least 10.

6. The abrasive article of claim 1, wherein the first polymer binder comprises a melamine.

7. The abrasive article of claim 6, wherein the third polymer binder comprises an acrylic latex.

8. An abrasive article, comprising:

a non-woven web comprising a bimodal blend of staple fibers bound together by a first polymer binder, the non-woven web forming a single layer that is free of any additional layers of non-woven webs;

a second polymer binder dispersed throughout the non-woven web; and abrasive particles bound to the non-woven web by a third polymer binder, wherein the bimodal blend of staple fibers comprises:

a first portion of staple fibers having a first averaged linear density of at least 125 deniers and not greater than 250 deniers;

a second portion of staple fibers having a second averaged linear density of at least 450 deniers and not greater than 600 deniers, wherein a difference between maxima of the first averaged linear density and the second averaged linear density is at least 200 deniers, wherein the first portion of staple fibers and the seconds portion of staple fibers are in a ratio ranging from about 40:60 to about 60:40, and wherein the first portion of staple fibers and the second portion of staple fibers comprise a polyamide, wherein the first polymer binder comprises a melamine, wherein the second polymer binder comprises a polyurethane, and wherein the third polymer binder comprises an acrylic latex.

* * * * *